United States Patent [19]

Leahan

[11] Patent Number: 4,678,206

[45] Date of Patent: Jul. 7, 1987

[54] PEN AND NOTE PAD

[76] Inventor: Daniel P. Leahan, 1420 S. Bayshore Dr. Apt. 402, Miami, Fla. 33131

[21] Appl. No.: 898,901

[22] Filed: Aug. 21, 1986

[51] Int. Cl.[4] ..... B42D 5/00; G09F 1/00; B65D 27/00

[52] U.S. Cl. ..... 281/15 B; 40/334; 229/68 R

[58] Field of Search ..... 281/15 B, 15 R; 40/152.1, 334; 428/23, 24, 25, 26, 313.5; D19/19, 23, 24, 28, 31, 36, 97; D11/34, 38; 229/68 R

[56] References Cited

U.S. PATENT DOCUMENTS

| | | | |
|---|---|---|---|
| D. 3,254,677 | 4/1980 | Burrows | D19/36 |
| D. 255,906 | 7/1980 | Kupperman et al. | D19/23 |
| D. 278,639 | 4/1985 | Cantonis | D19/28 |
| 1,305,245 | 6/1919 | Barthelemy | 40/334 |
| 2,602,250 | 7/1952 | Raising | 428/26 |
| 2,881,556 | 4/1959 | Rosa | 281/15 B |
| 3,764,167 | 10/1973 | Longarzo | 281/15 B |

*Primary Examiner*—Paul A. Bell
*Assistant Examiner*—Paul M. Heyrana, Sr.
*Attorney, Agent, or Firm*—Cushman, Darby & Cushman

[57] ABSTRACT

The present invention relates to a combination note pad and pen holder with the pad being formed in the shape of an open flower blossom the pad being adhered to a base member having the same flower shaped peripheral design. The base also includes a depending writing implement receptacle with both the depending receptacle and the writing instrument serving to appear as the stem of the flower.

9 Claims, 3 Drawing Figures

PEN AND NOTE PAD

FIELD OF THE INVENTION

The present invention relates to a combination note pad and a holder that serves to hold both the pad of note paper as well as a pen or pencil.

BACKGROUND OF THE PRESENT INVENTION

Various types of ornamental and utility note pads have been designed. For example the office products produced by the 3M Corporation called "Post-it" pads are rectangularly shaped pads which come in a variety of sizes. Individual sheets within the pad being stuck together by a releasing adhesive that will stick to paper but be releasable therefrom, with that adhesive also serving to hold the entire pad together as one assembly.

Variously shaped ornamental pad holders have also been developed such as those that appear like a paint brush (shown in Cantonis U.S. Pat. No. D278,639) or as a musical symbol as in Multer U.S. Pat. No. D278,640. In addition more traditional note pads have been developed such as those shown in Kahn U.S. Pat. No. D80,833 wherein the pad comprises a base on which sheets are retained by means of a plate screwed to the base holder at one end of the pad. The plate is provided with a receptacle for a pen with that receptacle being connected to the plate by means of a socket and ball bearing. A note pad and writing implement holder is also shown in Longarzo U.S. Pat. No. 3,764,167 wherein a rectangular box which contains a pad is provided with a receptacle on one side thereof for receiving a pen or pencil, the box also being provided with a bracket which may be selectively attached at either of two positions on the box so that the assembly may be adhered to a vertical surface such as the side of a telephone or be supported at an angle for use on the top of a desk or table. A combined note pad dispenser and pen holder is shown in Moustakas, U.S. Pat. No. D241,433 wherein a pen having a feather shaped end portion is mounted by means of a pear shaped housing with a lip provided on one side, about in the center of the housing, having an opening from which note paper can be dispensed.

Other related prior art includes Felger, U.S. Pat. No. D73,778 which shows a pencil having adhered to one end thereof a small bouquet of flowers, including petals and a bud, and Turnbull et al, U.S. Pat. No. 4,487,801 disclosing a device for releasing a fragrance, wherein rupturable microcapsules of a fragrance are contained in the adhesive material which temporarily bonds two sheets together, microcapsules being ruptured when the sheets are pulled apart thus releasing the liquid contained therein.

None of these prior devices suggest a flower shaped pad from which the writing implement, held to the pad, appears in the form of a stem.

SUMMARY OF THE INVENTION

The present invention comprises a base on which a plurality of sheets which together comprise a note pad are mounted, with the individual sheets being conveniently held together in a stack so that the topmost sheet is removable from the ones therebelow. The base and the stack of note sheets is preferably shaped like a flower blossom, preferably an opened flower blossom. The base includes a receptacle for holding a pen or pencil with the receptacle and the pen having the appearance of a stem of the flower.

Each sheet of the paper will preferably have a floral design and the note pads are preferably impregnated with a pleasant scent. The individual sheets can be held together in a stack by a variety of means, including an adhesive strip provided along an appropriate vertical edge of the stack or a temporary adhesive provided on a portion of the back of each individual sheet.

Other objects, features, and characteristics of the present invention, as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PREFERRED EXEMPLARY EMBODIMENT OF THE PRESENT INVENTION

Figure 1:
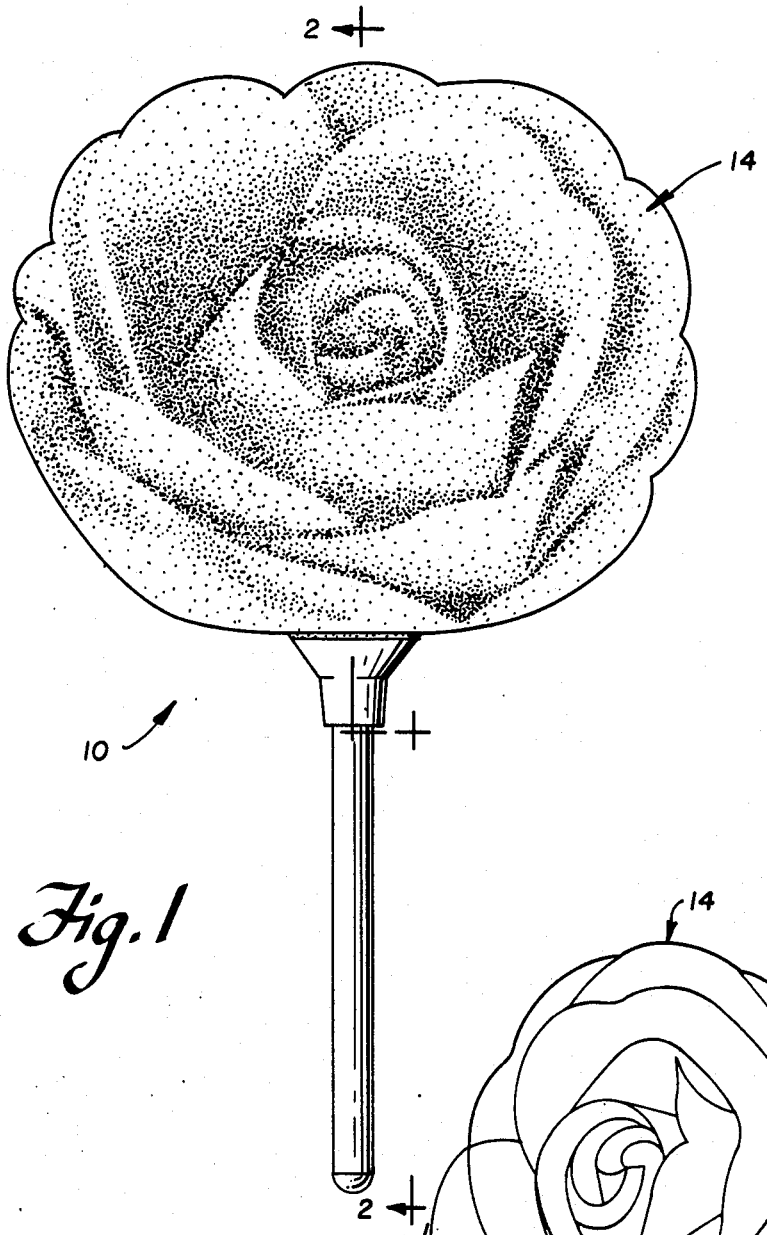
FIG. 1 shows a top plan view of the note pad and pen holder in its assembled condition.
Figure 2:
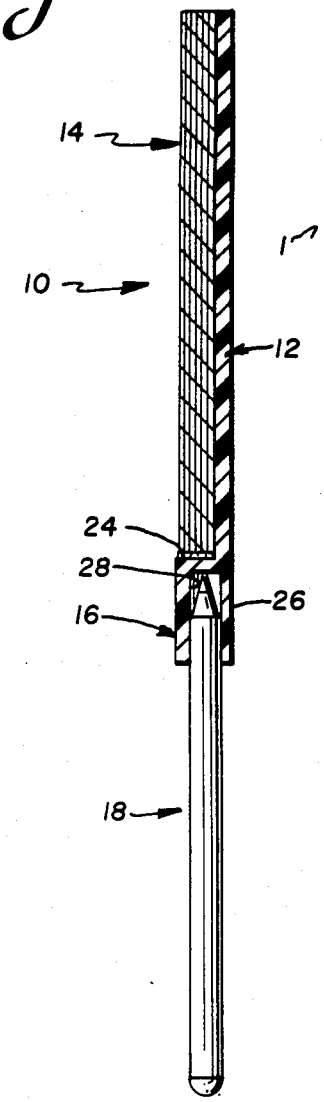
FIG. 2 is a side elevational view, of the device in FIG. 1, with the pad portion being shown in cross-section taken along line 2—2 in FIG. 1.
Figure 3:
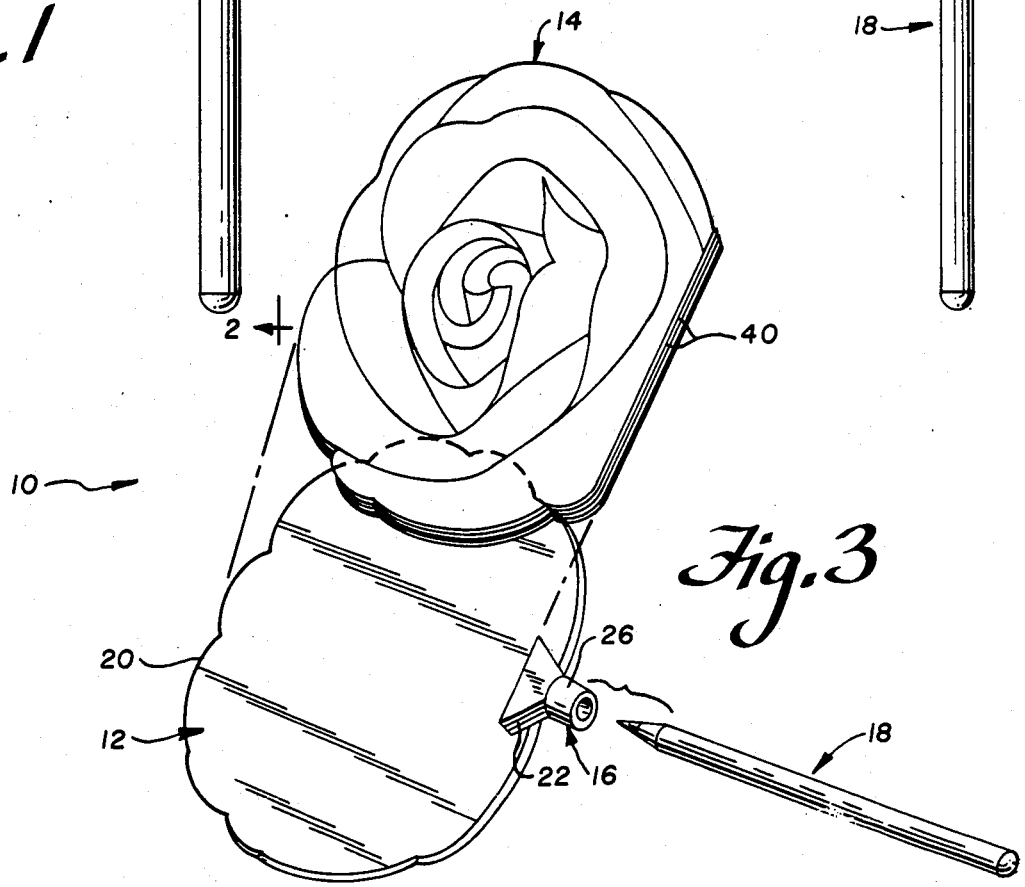
FIG. 3 is an explained perspective view showing the pad, the pad holder and the writing implement in a disassembled condition for clarity purposes.

With reference to FIG. 1, the pad is generally indicated at 10 and is comprised of a base 12, best indicated in FIGS. 2 and 3, a pad of a plurality of note sheets 14, an implement receptacle 16, which is preferably integrally formed with base 12, and a writing implement 18.

The base 12 will be provided with a shaped outer periphery 20, preferably in the form of the outline of an open flower blossom, as indicated by the top sheet of note paper in FIGS. 1 and 3. The receptacle 16 is preferably integrally formed together with base 12 from a plastic or thermoplastic material, by conventional molding techniques, such as, for example, injection molding although it could be formed from other materials or by other techniques. Receptacle 16 includes preferably trapazoidally shaped upper portion 22 having flat surface 24 abutting note pad 14. Upper surface 24 is substantially aligned with the bottom edge of the periphery of base 12, as shown in FIGS. 1 and 3, so that the note pad will appear to sit on surface 24 with the upper portion 22 extending outwardly or downwardly therefrom. The upper portion 22 has approximately the same thickness as that of note pad 14 together with base 12. Receptacle 16 also includes an annularly shaped lower portion 26 which extends downwardly from and is integral with upper portion 22. Further, annularly shaped lower portion 26 is provided with an internal bore or opening 28 extends through portion 26 into portion 22, with bore 28 having a size sufficient to snugly receive, as for example by a friction fit, the front end of the writing implement 18. Preferably the bore or passageway 28 has a sufficient length so as to receive a sufficient portion of the writing implement 18 so that the latter will be firmly held and not drop out and can be, for example, $\frac{5}{8}$ inches in length.

The note pad 14 is comprised of a plurality of individual sheets of paper forming a stack which is shaped to have the same outer periphery as the individual sheets and base 12. The pad itself will be adhered to base 14 for example by any convenient adhesive such as padding compound, with each of the individual sheets being held together by means of an adhesive such as that shown at 40 which is applied, for example, along the bottom edge of the stack which abuts flat surface 24 of the receptacle as indicated in FIG. 3. Other arrangements are also possible such as using a temporary adhesive between each of the sheets to allow them to be pulled apart and adhered to another surface or any other convenient means of retaining the individual sheets together without using any additional holding device.

Each sheet of paper can be scented which can be provided by any conventional process and does not otherwise form a part of the present invention.

Similarly, writing implement 18 can either be a pencil or a pen, with the latter either being a felt tip type pen or one that would use a replaceable insert.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

It should be noted that base 12 has a shaped outer periphercy, substantially like an open flower blossom and includes shaped top, side and bottom portions. Further, receptacle 16 is provided on the bottom portion, preferably at a substantially straight area that will substantially align with the bottom of the pad 14. Accordingly, receptical 16, and in particular portions 22 and 26, form in effect the flower base of the transition from the flower to the stem in the form of the implement 18.

I claim:

1. A combination note pad and writing implement holder comprising a base member having a planar portion provided with shaped top, side and bottom perpheral portions, a portion of the bottom periphery being provided with a substantially straight area, implement receptacle means being integrally formed with said base member and extending outwardly from said bottom peripheral portion, a note pad comprised of a plurality of sheets of paper, said note pad having an outer peripheral shape substantially identical to the peripheral shape of said base member, means for adhering said note pad to said base and an implement received within said receptacle means so that said implement extends outwardly away from said base member.

2. The combination of claim 1, wherein said outer peripheral shape is substantially in the form of an open flower blossom.

3. The combination of claim 1, wherein said receptacle means includes an upper trapizoidal portion and a lower cylindrical portion, said uppor portion including a flat upper surface substantially aligned with the bottom portion of the periphery of the base member, said receptacle means further including means defining a bore extending substantially therethrough.

4. The combination of claim 1, wherein at least the top and side peripheral portions of said base member have a scalloped shape.

5. A note pad and writing implement holder assembly comprising (1) a flat base having a periphery shaped like a flower blossom (2) means for holding a writing implement, said means being continuous with said base and having means defining a hollowed out portion into which a writing implement may be inserted and held tightly extending parallel to the plane defined by said base (3) a note pad positioned on said base and beside said implement holding means said note pad comprising a stack of a plurality of individual sheets of paper having the same peripheral shape as said base the entire assembly having a peripheral shape of a flower wherein the base and pad resemble a flower blossom and the writing implement together with said implement holding means resembles a stem for the flower blossom.

6. A note pad assembly as in claim 5, wherein the trapizoidally shaped holding means, having thickness of the note pad and a flat end which abuts the note pad.

7. A note pad assembly as in claim 5, wherein the adhesive on the side of the note pad which abuts the holding means.

8. A note pad assembly as in claim 5, wherein the sheets of paper having an imprint of petals of the flower blossom.

9. A note pad assembly as in claim 5, wherein the assembly is impregnated with a sweet scent.

* * * * *